United States Patent [19]

Noland

[11] Patent Number: 4,953,782

[45] Date of Patent: Sep. 4, 1990

[54] FRESH PRODUCE SHIPPING CONTAINER WITH SELF-LOCKING TOP

[75] Inventor: Carl M. Noland, Winter Haven, Fla.

[73] Assignee: Nekoosa Packaging Corporation

[21] Appl. No.: 409,780

[22] Filed: Sep. 20, 1989

[51] Int. Cl.[5] ..... B65D 5/10

[52] U.S. Cl. ..... 229/157; 229/156; 229/185; 229/DIG. 5

[58] Field of Search ..... 229/156, 157, 185, DIG. 2, 229/DIG. 5

[56] References Cited

U.S. PATENT DOCUMENTS

| | | | |
|---|---|---|---|
| 2,361,603 | 10/1944 | Cohen et al. | 229/157 |
| 3,272,421 | 9/1966 | Perry | 229/157 |
| 3,294,221 | 12/1966 | Notko et al. | 229/157 |
| 3,539,090 | 11/1970 | Blasdell | 229/157 |
| 3,878,980 | 4/1975 | Crane | 229/DIG. 11 |
| 4,279,377 | 7/1981 | Peeples et al. | 229/157 |
| 4,291,827 | 9/1981 | Mulroy | 229/156 |
| 4,367,840 | 1/1983 | McFadden | 229/157 |
| 4,389,013 | 6/1983 | Hall et al. | 229/23 R |
| 4,650,112 | 3/1987 | Bath | 229/157 |
| 4,702,408 | 10/1987 | Powlenko | 229/157 |
| 4,821,949 | 4/1989 | Booth | 229/157 |

*Primary Examiner*—Gary E. Elkins

*Attorney, Agent, or Firm*—Thomas A. Meehan; John R. Nelson

[57] ABSTRACT

A corrugated fiberboard shipping container for fresh produce the container having a tubular body, a bottom closure which is formed by four bottom flaps, and a re-openable and re-closable top closure at the top of the container. The top closure is formed by four top flaps, each top flap being folded inwardly with respect to the body panel to which it is attached to extend transversely therefrom. Each of an opposed pair of top flaps has a pair of spaced apart elongate slots therein which extend, respectively from the juncture of each such top flap with its body panel partly to the free edge thereof. Each of the other opposed pair of top flaps has a pair of spaced apart cuts therein extending from the free edge partly to the juncture of such top flap with its body panel. The cuts form a spaced apart pair of locking tabs in the free edge of each of the other opposed pair of top flaps with an intermediate tab therebetween. The locking tabs, which are non-hingedly joined to the portions of the flaps which are inward thereof, are received in locking engagement in the elongate slots of the other pair of top flaps.

37 Claims, 3 Drawing Sheets

FRESH PRODUCE SHIPPING CONTAINER WITH SELF-LOCKING TOP

BACKGROUND OF THE INVENTION

1. Field Of The Invention

This invention relates to a generally parallelepiped shipping container which is formed from a die-cut blank of a relatively rigid, foldable sheetlike material and which incorporates a self-locking top. This invention also relates to a die-cut blank of a relatively rigid, foldable sheetlike material from which such a shipping container can be formed. The preferred embodiment of this invention is a shipping container for fresh produce which can be provided with openings therein of substantial magnitude for good air circulation through the container.

2. Description Of The Prior Art

A generally parallelepiped or six-sided container of the type which is formed from a die-cut blank of a foldable, sheetlike material, for example, corrugated fiberboard, and which incorporates a self-locking feature, is shown in U.S. Pat. No. 3,272,421 (G. E. Perry). The aforesaid Perry patent discloses a six-sided container with such a self-locking feature at the bottom thereof. As is clear from this reference, the flaps at the bottom of the container which form the self-locking feature must be pushed a substantial distance into the interior of such container to engage one another in a self-locking manner. Thus, the self-locking feature of the container of this reference is suited for use with an empty container, but not for use with a container whose interior is filled with contents when the self-locking flaps are engaged. Further, the locking tabs of the locking flaps which extend into the interiors of the container are held flush with the other flaps which form the self-locking bottom by the weight of the contents which is placed therein. Thus, in a self-locking bottom, as opposed to a self-locking top, inherently the leading edge of the locking flap can not be jammed into the contents of the container. Further, yet the container of this reference is disclosed as being suited for the packaging of potato chips in polyethylene bags. Thus, this container does not incorporate the type of openings which are occasionally desirable in a container for fresh produce, such as grapefruit. In that regard, see U.S. Pat. No. 4,389,013 (Hall et al.) which shows ventilating openings in a fruit and vegetable produce container with a self-locking lid.

U.S. Pat. No. 3,294,221 (M. F. Notko et al.) describes a wardrobe container with a front panel which has an upper portion, and the upper portion is foldable to provide a hinged access door. A hanger bar is positioned near the top structure of this container, and this hanger bar is covered by a self-locking top which is engageable without being pushed a substantial distance into the interior of the container, an engagement technique that is precluded by the presence of the hanger bar. The self-locking top is formed by flaps at the top panels of the sides of the container, an opposed pair of such top flaps each having spaced apart locking tabs which are foldably attached along a scored or otherwise deformed line to a side flap which, in turn, is foldably attached to one of the opposed pair of side panels, one of which is the foldable portion of the front panel. The locking tabs, by virtue of their separation from the side flap to which they are joined, tend to bend at an oblique angle with respect thereto, and, thus, project into the interior of the Notko et al. container. This may not be a problem in a wardrobe container since the contents, garments, are probably suspended from hangers, and are not positioned close enough to the top of the container to be contacted, and possibly damaged, by the edges of the locking tabs which project into the interior of the container. However, this feature could be troublesome in a container with a self-locking top which is intended for the packaging of fresh produce, since the contents, which can be readily damaged, are usually positioned all the way to the top of the container. Thus, the contents of a fresh produce container can readily be contacted, and damaged, by the thin, leading edges of the locking tabs of a top structure like that of the Notko et al. container if they project obliquely into the interior of the container. Further, the top structure of the Notko et al. container is essentially imperforate, to prevent the entrance of dust and moisture into the container. Thus, such top structure lacks the type of openings which are occasionally desirable in a container for fresh produce.

U.S. Pat. No. 3,539,090 (R. O. Blasdell) also discloses a six-sided shipping container with a self-locking top. The locking tabs of the top flaps extend from flaps which are attached to the minor, or smaller, side panels, rather than the larger, or major, side panels as in the case of the Notko et al. container, and are also flexible with respect to interior portions of such flaps by virtue of the presence of scored or otherwise deformed lines, called "flexure creases" in the reference.

SUMMARY OF THE INVENTION

According to the present invention there is provided a six-sided or parallelepiped shipping container which is formed from a die-cut blank of a relatively rigid sheetlike material such as corrugated fiberboard, the folding of portions of such blank relative to adjacent portions thereof being facilitated by the strategic placement of cuts and scored or otherwise deformed lines in the blank. The blank has four serially connected side panels which are separated from one another by scored or otherwise deformed lines and which, when the container of the present invention is to be erected from such blank, are joined with the free edge of the first of such panels being connected to the free edge of the last of such panels, for example, by joining a tab, which is formed in the blank at the free edge of the first or last of the panels and is foldably attached thereto along a scored line, to the free edge of the other of the first of the panels by an adhesive, tape, or staples. Thus, in the semi-erected state of the container, the side panels form a double open-ended tubular body member of rectangular cross-section.

The bottom of the container is formed by a series of four flaps which are joined to the bottoms of the side panels along scored lines and which are separated from one another by slots or other lines of cut. Thus, each bottom flap is foldable inwardly with respect to the side panel to which it is attached to extend normally therefrom, and when all such bottom flaps are so inwardly folded, preferably in a predetermined sequence, they will overlie one another to form a generally horizontally extending bottom to the container, and they may be secured to one another to maintain their respective positions in the bottom by an adhesive, tape, or staples.

The self-locking top of the container is formed by a series of four flaps which are joined to the tops of the side panels along scored lines and which are separated from one another by slots or other lines of cut. Each of an opposed pair of such top flaps, preferably the top flaps which are attached to the shorter width or minor side panels of a rectangular container whose adjacent sides are of even width, is provided with a pair of spaced apart, elongate slots which extend at least from the scored line between such top flap and the side panel to which it is attached partly toward the free edge of the top flap, and transversely of such scored line. Each of the other opposed pair of top flaps has a pair of spaced apart locking tabs extending partly from the free edge thereof to the second line which separates such top flap from the side panel to which it is foldably attached, and an intermediate tab between the spaced apart locking tabs which is separated from the spaced apart locking tabs by lines of cut which extend partly from the free edge of such top flap to the scored line which separates it form its side panel. The locking tabs are non-hingedly joined to the portions of the top flap which are immediately beyond the ends of the lines of cut that separate the locking tabs from the intermediate tab, that is, there is no scored or otherwise deformed line in the blank from which the container is erected within either of the locking tabs or at the base thereof, so that the locking tabs will remain relatively co-plainer with the portions which extend therefrom. Thus, in the erected container the locking tabs will not tend to extend obliquely into the interior of the container, and, consequently, their free edges will tend to avoid jamming into and damaging fresh produce items packaged in the container. In any case, in the closing of the top of the container, the top flaps with the elongate slots are folded into inwardly extending positions normally of the body panels to which they are attached. Then, the other top flaps are folded to overlie the top flaps with the elongate slots, which serve as the inner flaps in the assembled container, and the locking tabs are inserted in the elongate slots of the inner top flaps to frictionally lock all top flaps to one another. The intermediate tabs in the outer top flaps remain on the outside of the container, to permit rapid re-opening of the container, for example, for inspection of the contents of a filled container. If desired, a substantial space can be provided between the free edges of the outer top flaps to provide for ventilation of the contents of the container, alone or in conjunction with other ventilation openings in the container, and for ready access to the free edges of the outer top flaps for easy opening of the container. The deformation of the outer top flaps which is desired to permit assembly in the manner heretofore described can be readily provided by deforming each of the outer top flaps along a line extending between its edges at a location inwardly of the junctures of the locking tabs and the intermediate tab, and outwardly spaced from the scored line between the top flap and its body panel. Preferably such deformation is by a series of spaced apart perforations, for example, ¼ inch wide perforations separated by ¼ inch wide unperforated portions which makes it very easy to bend the intermediate tab relative to the other portions of its top flap, while at the same time ensuring good rigidity in the locking tabs so that they remain relatively co-planar with the bottom flaps in the assembled container.

Accordingly, it is an object of the present invention to provide an improved, six-sided shipping container with a self-locking top, and it is a corollary object to provide a blank of a relatively rigid, foldable sheetlike material from which such a container can be formed. More particularly, it is an object of the present invention to provide a six-sided shipping container with a self-locking top which can be closed or opened and reclosed after the container has been filled, and which is free of edge portions projecting obliquely into the interior of the container in a way which could lead to damage of the contents of the container during the closing or reclosing of the container, especially fresh produce items, and it is a corollary object to provide a blank of a relatively rigid, sheetlike material from which such a container can be formed.

For a further understanding of the present invention and the objects thereof, attention is directed to the drawing and the following brief description thereof, to the detailed description of the preferred embodiment, and to the appended claims.

DETAILED DESCRIPTION OF THE PREFERRED EMBODIMENT

Figure 1:
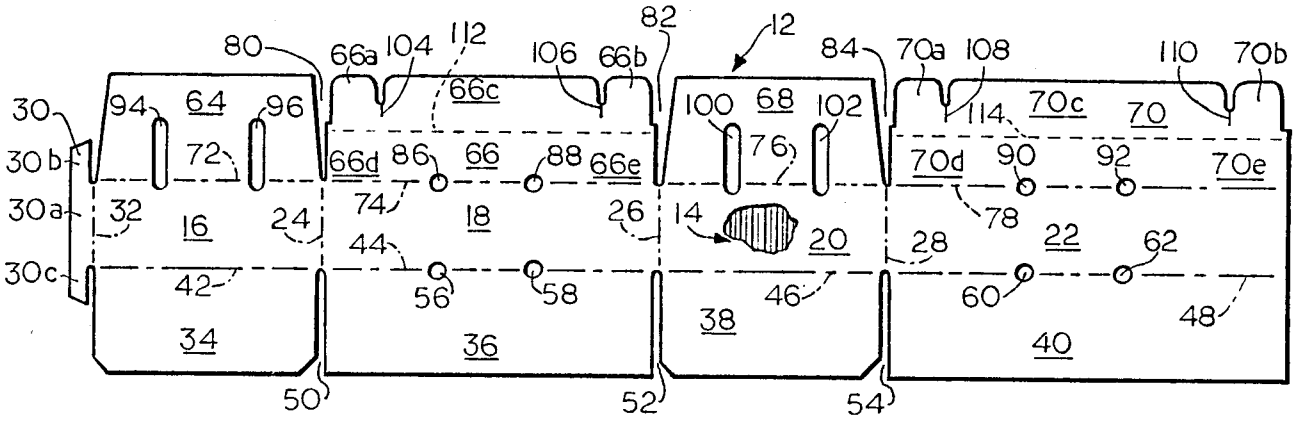
FIG. 1 is a plan view of die-cut, generally rectangular blank of a relatively rigid, foldable sheetlike material according to a preferred embodiment of the present invention and from which a shipping container according to a preferred embodiment can be formed.
Figure 5:
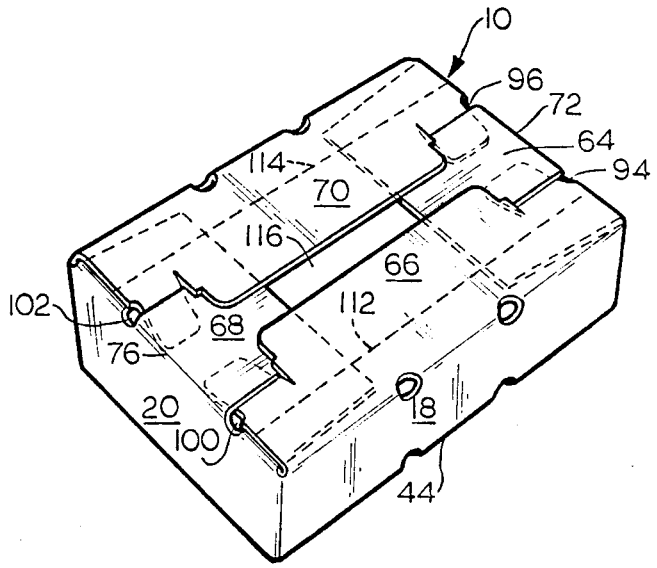
FIG. 5 is a perspective view of a shipping container according to the preferred embodiment of the present invention which has been formed from the blank of FIG. 1.

As is shown in FIG. 5, a shipping container according to a preferred embodiment of the present invention is indicated generally be reference numeral 10. The container 10 is formed from a generally rectangular blank according to the preferred embodiment of the present invention which is shown in FIG. 1 and which is identified generally by reference numeral 12. The blank 12 is formed by die-cutting a sheet of a relatively rigid, foldable sheetlike material, preferably corrugated fiberboard, and a visible portion of the blank 12 is broken away at a location indicated generally by reference numeral 14 to illustrate the preferred direction of the corrugations in the corrugated medium portion thereof when the blank 12 is formed from corrugated fiberboard, for good stacking strength in the assembled container 10.

The blank 12 includes four serially connected and rectangularly shaped body panels 16, 18, 20, and 22. The panels 16 and 18 are hingedly or foldably attached to one another along a fold line 24; the panels 18 and 20 are hingedly or foldably attached to one other along a fold line 26; and the panels 20 and 22 are hingedly or foldably attached to one other along a fold line 28. The fold lines 24, 26, and 28, which run parallel to one another and in the height direction of the assembled container 10, are formed by scoring or otherwise deforming the blank 12 therealong. The blank 12, at the level of the body panels 16, 18, 20, and 22, also has a flap 30 which is hingedly or foldably attached to the otherwise free edge of the panel 16 along a fold line 32, which is also formed by scoring or otherwise deforming the blank 12 therealong, and which also runs parallel to the fold lines 24, 26, and 28. For purposes which will be hereinafter explained more fully, the flap 30 is made up of an interior portion **30*a* which is aligned with the body panel 16 and upper and lower portions 30*b* and 30*c*** which extend from the interior portion 30*a* respectively above and below the level of the body panel 16 and the fold line 32.

The bottom edges of the body panels 16, 18, 20, and 22, in the orientation of the blank 12 which is illustrated in FIG. 1, respectively have bottom flaps 34, 36, 38 and 40 hingedly or foldably joined thereto at fold lines 42, 44, 46, and 48, respectively, the fold lines 42, 44, 46, and 48, which are in alignment with one another and which extend normally of the fold lines 24, 26, and 28, being formed by scoring or otherwise deforming the blank 12 therealong. The bottom flaps 34, 36, 38, and 40 are separated from one another by spaced apart, cut slots 50, 52, and 54 each of which extends from the free, bottom edge of the blank 12 to the level of the aligned fold lines 42, 44, 46, and 48 and transversely thereof. As shown and if desired, a spaced apart pair ventilation holes 56 and 58 is placed in the blank 12 at the juncture of one of its body panels and the bottom flap which is foldably attached to it, shown as the body panel 18 and the bottom flap 36, and another spaced apart pair of ventilation holes 60 and 62 is placed at the juncture of the opposed body panel, panel 22, and its bottom flap, flap 40, to facilitate the flow of air through the contents of the container 10 which is to be formed from the blank 12, as such a feature is often desirable in a container intended for the packaging of fresh produce items therein.

The top edges of the body panels 16, 18, 20, and 22, in the orientation of the blank which is illustrated in FIG. 1, respectively have top flaps 64, 66*c*, 68, and 70*c* hingedly or foldably joined thereto at fold lines 72, 74, 76, and 78, respectively, the fold lines 72, 74, 76, and 78, which are in alignment with one another and which extend normally of the fold lines 24, 26, and 28, being formed by scoring or otherwise deforming the blank 12 therealong. The top flaps 64, 66, 68, and 70 are separated by irregularly shaped spaced apart cut slots 80, 82, and 84 each of which extends from the free top edge of the blank 12 to the level of the aligned fold lines 72, 74, 76, and 78 and transversely thereof. As shown and if desired, a spaced apart pair of ventilation holes 86 and 88 is placed in the blank 12 at the juncture of the body panel 18 and the top flap 66 which is foldably attached to it, and another spaced apart pair of ventilation holes 90 and 92 is placed at the juncture of the opposed body panel, panel 22, and its top flap, flap 70, to further facilitate the flow of air through fresh produce items packaged therein.

An opposed pair of the top flaps, preferably being the width or minor or smaller, from side to side, flaps in a container in which adjacent flaps have unequal side to side dimensions, namely the top flaps 64 and 68 in the configuration of the blank 12 which is illustrated in FIG. 1, are each provided with a spaced apart pair elongate slots, namely slots 94 and 96 in the top flap 64 and slots 100 and 102 in the top flap 68. The slots 94 and 96 extend normally from the fold line 72 partly to the free edge of the top flap 64, and the slots 100 and 102 extend normally from the fold line 76 partly to the free edge of the top flap 68. The other opposed pair of top flaps, preferably the length or major or larger, from side to side, flaps in a container in which adjacent flaps have unequal side to side dimensions, namely the top flaps 66 and 70 in the configuration of the blank 12 which is illustrated in FIG. 1, are each provided with a pair of spaced apart lines of cut, namely cuts 104 and 106 in the top flap 66 and cuts 108 and 110 in the top flap 70.

The cuts 104 and 106 are positioned inwardly from the side edges of the top flap 66 and extend normally from the free edge of the top flap 66 partly to the fold line 74. Thus, the cuts 104 and 106 form a series of three tabs in the margin of the top flap 66, end tabs 66*a* and 66*b* at the outer edges of the flap 66 and an intermediate tab 66*c* between the end tabs 66*a* and 66*b*. Preferably, as shown, each of the end tabs 66*a* and 66*b* is considerably smaller, in its side to side dimension, than the intermediate tab 66*c*. An intermediate fold line 112 is positioned below the base of the intermediate tab 66*c*, between and parallel to the free edge of the top flap 66 and the fold line 74, at least approximately one inch inwardly of the inner ends of the cuts 104 and 106. The fold line 112, which is preferably formed by spaced apart perforated and unperforated portions, for example by spaced apart ¼ inch wide performations and ¼ inch wide unperforated portions, permits ready folding of the intermediate tab 66*c* with respect to other portions of the top flap 66 while ensuring that the end tab portions 66*a* and 66*b*, which are not separated from the portions of the top flap 66 which lie immediately inwardly thereof and which are identified by reference numerals 66*d* and 66*e*, respectively, can remain substantially coplanar with such inward portions 66*d* and 66*e*, respectively.

The cuts 108 and 110 are positioned inwardly from the side edges of the top flap 70 and extend normally from the free edge of the top flap 70 partly to the fold line 78. Thus, the cuts 108 and 110 form a series of three tabs in the margin of the top flap 70, end tabs 70*a* and 70*b* at the outer edges of the flap 70 and an intermediate tab 70*c* between the end tabs 70*a* and 70*b*. Preferably, as shown, each of the end tabs 70*a* and 70*b* is considerably smaller, in its side to side dimension, than the intermediate tab 70*c*. An intermediate fold line 114 is positioned below the base of the intermediate tab 70*c*, between and parallel to the free edge of the top flap 70 and the fold line 78, at least approximately one inch inwardly of the inner ends of the cuts 108 and 110. The fold line 114, which is preferably formed by spaced apart perforated and unperforated portions, for example by spaced apart ¼ inch wide perforations and ¼ inch wide unperforated portions, permits ready folding of the intermediate tab 70*c* with respect to other portions of the top flap 70 while ensuring that the end tab portions 70*a* and 70*b*, which are not separated from the portions of the top flap 70 which lie immediately inwardly thereof and which are identified by reference numerals 70*d* and 70*e*, respectively, can remain substantially coplanar with such inward portions 70*d* and 70*e*, respectively.

Figure 2:
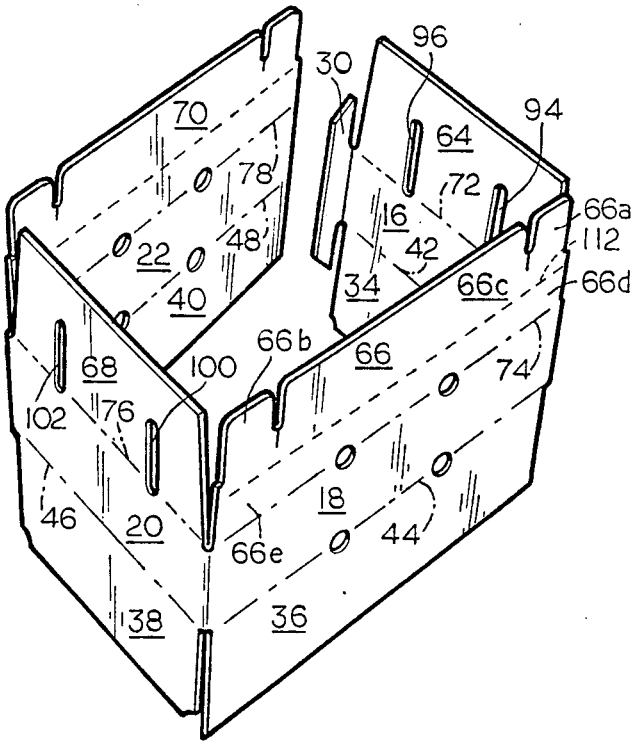
FIGS. 2 through 4 are perspective views illustrating various stages in the forming of a shipping container from the blank of FIG. 1.
Figure 3:
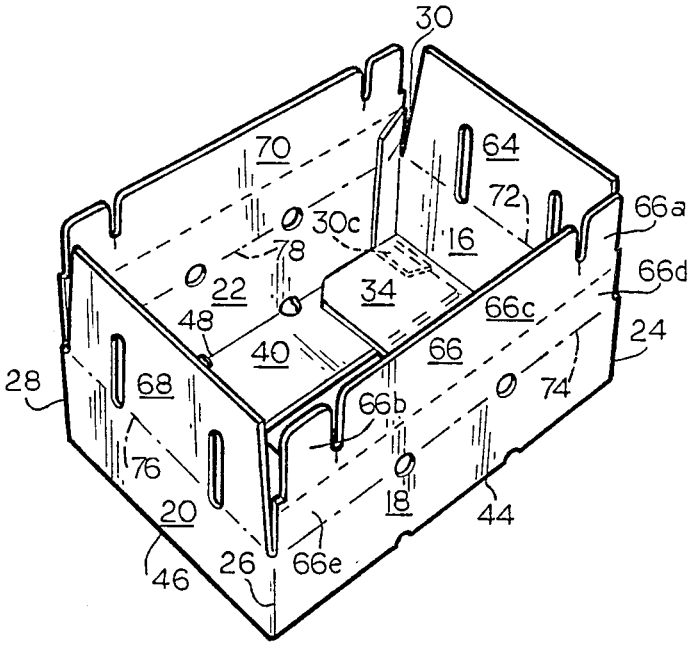

The container 10 is formed from the blank 12 by folding the blank 12 at the fold lines 24, 26, and 28 into a generally rectangular, tubular configuration, with the flap 30 being positioned adjacent to a marginal portion of the body panel 22, as is shown in FIG. 2. Subsequently, the interior portion 30*a* of end flap 30 is secured to such marginal portion of the body panel 22, on the interior portion thereof, by means, not shown, such as an adhesive, a strip of a pressure sensitive tape, or staples, in what is frequently referred to as a manufacturers joint. Subsequently, as is shown in FIG. 2, the bottom of the completed container 10 is formed by inwardly folding the bottom flaps 34 and 38 with respect to their respective body panels 16 and 20 about the fold lines 42 and 46, respectively, to extend in alignment toward one another and normally of their respective body panels 16 and 20, and by then infolding the bottom flaps 36 and 40 to overlie the infolded bottom flaps 34 and 38, extending in alignment toward one another and normally of their respective body panels 18 and 22. Subsequently, the bottom flaps 34, 36, 38, and 40 are secured to one another by means, not shown, such as an adhesive, a pressure sensitive tape or staples.

As previously noted, the tab 30 has upper and lower portions 30*b* and 30*c*, respectively, and these portions are provided to prevent tearing of the joint which is formed between the tab 30 and the body panel when the bottom of the container 10 is formed, as has been heretofore described, and when the top of the container 10 is formed, as will hereinafter be described. In any case, the lower portion 30*c* of the tab 30 is preferably folded to extend parallel to the bottom flaps 34, 35, 38, and 40 after the folding of the inner bottom flaps 34 and 38 and before the folding of the outer bottom flaps 36 and 40 so that it will be trapped between the bottom flap 34 and the bottom flap 40, where its edges will not be exposed either to produce packaged in the container 10 or to structure on the outside of the container 10.

Figure 4:
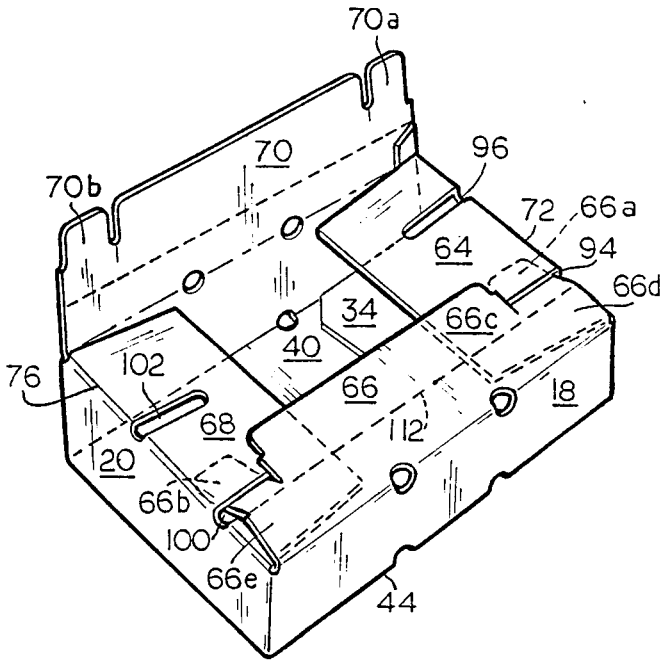

As is shown in FIG. 4, the top of the container is formed by inwardly folding the slotted top flaps, the flaps 64 and 68, with respect to their respective body panels 16 and 20 about the fold lines 72 and 76, respectively, to extend in alignment toward one another and generally normally of their respective body panels 16 and 20. Then, one of the other top flaps, shown in FIG. 4 as the top flap 66, is folded with respect to its body panel, the body panel 18, about the fold line 44, to partly overlie the inwardly folded slotted top flaps 64 and 68, with the leading edge of the end tab 66*a* being inserted into the slot 94 in the top flap 64 and the leading edge of the end tab 66*b* being inserted into the slot 100 of the top flap 68, thereby frictionally and disengagingly locking the top flap 66 and the slotted top flaps 64 and 68 to one another. The bending of the top flap 66 which is needed to effect the insertion of the end tabs 66*a* and 66*b* into the slots 94 and 100, as heretofore described, can be effected by hand bending the intermediate tab portion 66*c* of the top flap about the fold line 112, and since there is no scoring or other deforming of the top flap 66 to form a hinge between the end tabs 66*a* and 66*b* and their respective inward portions 66*d* and 66*e*, in the finished container 10 the end tabs 66*a* and 66*b* will extend generally parallel to the end flaps 64 and 68, and therefore generally co-planar with their respective inward portions 66*d* and 66*e*, and will not project obliquely downwardly into the interior of the container 10 where their leading edges might otherwise jam into and damage produce items therein.

After the closing of the top flap 66, as heretofore described, its opposed top flap, flap 70, is folded with respect to its body panel, the body panel 22, about the fold line 48, to partly overlie the inwardly folded slotted top flaps 64 and 68, with the leading edge of the end tab 70*a* being inserted into the slot 96 in the top flap 64 and the leading edge of the end tab 70*b* being inserted into the slot 102 of the top flap 68, thereby frictionally and disengagingly locking the top flap 70 and the slotted top flaps 64 and 68 to one another, through the top flaps 64 and 68 to the top flap 66. The bending of the top flap 70 which is needed to effect the insertion of the end tabs 70*a* and 70*b* into the slots 96 and 102, as heretofore described, can be effected by hand bending the intermediate tab portion 70*c* of the top flap about the partial fold line 114, and since there is no scoring or other deforming of the top flap 70 to form a hinge between the end tabs 70*a* and 70*b* and their respective inward portions 70*d* and 70*e*, in the finished container 10 the end tabs 70*a* and 70*b* will extend generally parallel to the end flaps 64 and 68, and therefore generally co-planar with their respective inward portions 70*d* and 70*e* and will not project obliquely downwardly into the interior of the container 10. In the forming of the self-locking top of the container 10 from the top flaps 64, 66, 68, and 70, as heretofore described, the upper portion 30*a* of the flap 30 is folded in with the top flap 70 to lie between the top flap 70 and the top flap 64, where its edges will not be exposed either to produce packaged in the container 10 or to structure on the outside of the container.

As is clear from the drawing, the depth of each of the major top flaps 66 and 70, from the leading edge thereof to the fold lines 74 and 78, respectively, is somewhat less than one-half of the side to side width of the minor flaps 64 and 68, that is, the dimension parallel to the fold lines 72 and 76, respectively. Thus, in the finished container there will be a substantial space 116 between the free edges of the major top flaps 66 and 70. While this feature is optional, in certain circumstances it may prove to be useful in providing further ventilation of the contents of the container, and, in any case, it will facilitate the opening of the filled container for inspection or removal of its contents.

Although the best mode contemplated by the inventor for carrying out the present invention as of the filing date hereof has been shown and described herein, it will be apparent to those skilled in the art that suitable modifications, variations and equivalents may be made without departing form the scope of the invention, such scope being limited solely by the terms of the following claims.

What is claimed is:

1. A shipping container having an interior and an exterior and being formed from a generally rectangular blank of a relatively rigid, foldable sheetlike material, said container comprising:

a tubular body portion formed from four serially connected body panels in said blank by bending along fold lines at the junctures of said body panels and by connecting the first and last of said serially connected body panels to one another, said tubular body portion including a first pair of opposed, spaced apart body panels that extend generally parallel to one another and a second pair of opposed, spaced apart body panels that extend generally parallel to one another and generally transversely of said first pair of opposed, spaced apart body panels, said tubular body portion having a first end extending transversely of said body panels and a second end spaced from said first end and extending transversely of said body panels; and self-locking means closing one of said first end and said second end of said tubular body portion, said self-locking means comprising:

first flap means comprising a pair of flaps, one of said pair of flaps having a free edge and being foldably attached to one of said first pair of body panels at a first transverse fold line, said one of said pair of flaps further being folded at said first transverse fold line to extend transversely with respect to said one of said first pair of body panels toward the other of said first pair of body panels, the other of said pair of flaps having a free edge and being foldably attached to the other of said first pair of body panels at a second transverse fold line, said other of said pair of flaps further being folded at said second transverse fold line to extend transversely with respect to said other of said first pair of body panels toward said one of said first pair of body panels, said one of said pair of flaps comprising at least one elongate slot extending transversely substantially from said first transverse fold line partly to the free edge of said one of said pair of flaps, said other of said pair of flaps comprising at least one elongate slot extending transversely substantially from said second transverse fold line partly to the free edge of said other of said pair of flaps; and second flap means comprising at least one flap, said at least one flap having a free edge and being foldably attached to one of said second opposed pair of body panels at a third transverse fold line and being folded at said third transverse fold line to extend transversely with respect to said one of said second opposed pair of body panels toward the other of said second opposed pair of body panels, said at least one flap being cut along spaced apart, parallel cut lines extending transversely from said free edge of said at least one flap partly to said third transverse fold line to form first and second end tabs and an intermediate tab between said first and second end tabs in said free edge of said at least one flap, a first inward portion between said first end tab and said third transverse fold line and a second inward portion between said second end tab and said third transverse fold line, said first end tab being received in said at least one elongate slot in said one of said pair of flaps interiorly of said one of said pair of flaps, said second end tab being received in said at least one elongate slot in the other of said pair of flaps interiorly of said other of said pair of flaps, said intermediate tab, said first inward portion and said second inward portion being positioned exteriorly of said one of said pair of flaps and said other of said pair of flaps, said first end tab being substantially coplanar with an immediately adjacent portion of said first inward portion and being non-hingedly connected thereto.

2. A container according to claim 1 wherein said second end tab is substantially coplanar with an immediately adjacent portion of said second inward portion and is non-hingedly connected thereto.

3. A container according to claim 2 wherein said at least one flap of said second flap means is deformed along an intermediate fold line which is positioned between said free edge of said at least one flap and said third transverse fold line and which extends generally parallel to said third transverse fold line, said intermediate fold line being spaced inwardly of inner ends of each of said spaced apart, parallel cut lines, said fold line permitting bending of said intermediate tab portion with respect to other portions of said at least one flap of said second flap means to permit said first end tab to be inserted into said at least one elongate slot in said one of said pair of flaps and to permit said second end tab to be inserted into said at least one elongate slot in said other of said pair of flaps.

4. A container according to claim 3 wherein said foldable, sheetlike material is corrugated fiberboard.

5. A container according to claim 1 wherein said third transverse fold line is longer than said first transverse fold line and said second transverse fold line.

6. A container according to claim 1 and further comprising:

means closing the other of said first end and said second end of said tubular body portion.

7. A container according to claim 6 wherein said other of said first end and said second end of said tubular body portion is the bottom of said container in the normal upright orientation of said container.

8. A container according to claim 7 wherein said means closing the other of said first end and said second end of said tubular body portion comprises;

third flap means comprising a pair of bottom flaps, the flaps of said pair of bottom flaps of said third flap means respectively being attached to opposed panels of one of said first pair and said second pair of body panels at first bottom transverse fold line means and being folded at said first bottom transverse fold line means to extend transversely respectively from the one of the panel of said opposed panels of said one of said first pair of body panels and said second pair of body panels toward the other panel of said opposed panels of said one of said first pair of body panels and said second pair of body panels; and fourth flap means comprising a second pair of bottom flaps, the flaps of said second pair of bottom flaps of said fourth flap means respectively being attached to opposed panels of the other of said first pair and said second pair of body panels at second bottom transverse fold line means and being folded at said second bottom transverse fold line means to extend respectively from one of the panels of said opposed panels of said other of said first pair of body panels and said second pair of body panels toward the other panel of said opposed panels of said other of said first pair of body panels and said second pair of body panels.

9. A container according to claim 8 wherein each of the bottom flaps of one of said third flap means and said fourth flap means overlies each of the bottom flaps of the other of said third flap means and said fourth flap means and further comprising;

means joining said third flap means to said fourth flap means.

10. A container according to claim 1 and further comprising vent hole means along said third transverse fold line.

11. A shipping container according to claim 3 wherein said intermediate fold line is spaced inwardly from said inner ends by a distance at least equal to approximately one inch.

12. A shipping container having an interior and an exterior and being formed from a generally rectangular blank of a relatively rigid, foldable sheetlike material, said container comprising:

a tubular body portion formed from four serially connected body panels in said blank by bending along fold lines at the junctures of said body panels and by connecting the first and last of said serially connected body panels to one another, said tubular body portion including a first pair of opposed, spaced apart body panels that extend generally parallel to one another and a second pair of opposed, spaced apart body panels that extend generally parallel to one another and generally transversely of said first pair of opposed, spaced apart body panels, said tubular body portion having a first end extending transversely of said body panels and a second end spaced from said first end and extending transversely of said body panels; and self-locking means closing one of said first end and said second end of said tubular body portion, said self-locking means comprising:

first flap means comprising a pair of flaps, one of said pair of flaps having a free edge and being foldably attached to one of said first pair of body panels at a first transverse fold line, said one of said pair of flaps further being folded at said first transverse fold line to extend transversely with respect to said one of said first pair of body panels toward the other of said first pair of body panels, the other of said pair of flaps having a free edge and being foldably attached to the other of said first pair of body panels at a second transverse fold line, said other of said pair of flaps further being folded at said second transverse fold line to extend transversely with respect to said other of said first pair of body panels toward said one of said first pair of body panels, said one of said pair of flaps comprising a pair of spaced apart elongate slots extending transversely substantially from said first transverse fold line partly to the free edge of said one of said pair of flaps, said other of said pair of flaps comprising a second pair of elongate slots extending transversely substantially from said second transverse fold line partly to the free edge of said other of said pair of flaps; and second flap means comprising a second pair of flaps, one of said second pair of flaps of said second flap means having a free edge and being foldably attached to one of said second opposed pair of body panels at a third transverse fold line and being folded at said third transverse fold line to extend transversely with respect to said one of said second opposed pair of body panels toward the other of said second opposed pair of body panels, said one of said second pair of flaps of said second flap means being cut along spaced apart, parallel cut lines extending transversely from said free edge of said one of said second pair of flaps of said second flap means partly to said third transverse fold line to form first and second end tabs and an intermediate tab between said first and second end tabs in said free edge of said one of said second pair of flaps of said second flap means, a first inward portion between said first end tab and said third transverse fold line and a second inward portion between said second end tab and said third transverse fold line, said first end tab being received in one of said pair of spaced apart elongate slots in said one of said pair of flaps of said first flap means interiorly of said one of said pair of flaps of said first flap means, said second end tab being received in one of said elongate slots in the other of said pair of flaps interiorly of said other of said pair of flaps, said intermediate tab, said first inward portion and said second inward portion being positioned exteriorly of said one of said pair of flaps and said other of said pair of flaps, said first end tab being substantially coplanar with said first inward portion and being ron-hingedly connected thereto, the other of said second pair of flaps having a free edge and being foldably attached to the other of said second opposed pair of body panels at a fourth transverse fold line and being folded at said fourth transverse fold line to extend transversely with respect to said other of said second opposed pair of body panels toward said one of said second opposed pair of body panels, said other of said second pair of flaps being cut along spaced apart, parallel cut lines extending transversely from said free edge of said other of said second pair of flaps partly to said fourth transverse fold line to form third and fourth end tabs and a second intermediate tab between said third and fourth end tabs in said free edge of said other of said second pair of flaps, a third inward portion between said third end tab and said fourth transverse fold line and a fourth inward portion between said fourth end tab and said fourth transverse fold line, said third end tab being received in the other of said pair of spaced apart elongate slots in said one of said pair of flaps of said first flap means interiorly of said one of said pair of flaps of said first flap means, said fourth end tab being received in the other of said elongate slots in the other of said pair of flaps interiorly of said pair of flaps, said second intermediate tab, said third inward portion and said fourth inward portion being positioned exteriorly of said one of said pair of flaps and said other of said pair of flaps, said third end tab being substantially coplanar with an immediately adjacent portion of said third inward portion and being non-hingedly connected thereto.

13. A container according to claim 12 wherein said fourth end tab is substantially coplanar with an immediate adjacent portion of said fourth inward portion and is non-hingedly connected thereto.

14. A container according to claim 13 wherein said one of said second pair of flaps of said second flap means is deformed along an intermediate fold line which is positioned between said free edge of said at one of said second pair of flaps and said third transverse fold line and which extends generally parallel to said third transverse fold line, said intermediate fold line being spaced inwardly of inner ends of each of said spaced apart, parallel cut lines of said one of said second pair of flaps of said second flap means, said intermediate fold line permitting bending of said intermediate tab portion with respect to other portions of said one of said second pair of flaps of said second flap means to permit said first end tab to be inserted into said one of said elongate slots in said one of said first pair of flaps of said first flap means and to permit said second end tab to be inserted into said one of said elongate slots in said other of said pair of flaps of said first flap means.

15. A container according to claim 14 wherein said other of said second pair of flaps of said second flap means is deformed along a second intermediate fold line which is positioned between said free edge of said other of said second pair of flaps of said second flap means and said fourth transverse fold line and which extends generally parallel to said fourth transverse fold line, said second intermediate fold line being spaced inwardly of inner ends of each of said spaced apart, parallel cut lines of said other of said second pair of flaps of said second flap means, said second intermediate fold line permitting bending of said second intermediate tab with respect to other portions of said other of said second pair of flaps of said second flap means to permit said third end tab to be inserted into the other of said elongate slots in said one of said first pair of flaps of said first flap means and to permit said fourth end tab to be inserted into the other of said elongate slots in said other of said pair of flaps of said first flap means.

16. A container according to claim 15 wherein said foldable, sheetlike material is corrugated fiberboard.

17. A container according to claim 12 and further comprising:

means closing the other of said first end and said second end of said tubular body portion.

18. A container according to claim 17 wherein said other of said first end and said second end of said tubular body portion is the bottom of said container in the normal upright orientation of said container.

19. A container according to claim 18 wherein said means closing the other of said first end and said second end of said tubular body portion comprises;

third flap means comprising a pair of bottom flaps, the flaps of said pair of bottom flaps of said third flap means respectively being attached to opposed panels of one of said first pair and said second pair of body panels at first bottom transverse fold line means and being folded at said first bottom transverse fold line means to extend transversely respectively from one of the panels of said opposed panels of said one of said first pair of body panels and said second pair of body panels toward the other panel of said opposed panels of said one of said first pair of body panels and said second pair of body panels; and fourth flap means comprising a second pair of bottom flaps, the flaps of said second pair of bottom flaps of said fourth flap means respectively being attached to opposed panels of the other of said first pair and said second pair of body panels at second bottom transverse fold line means and being folded at said second bottom transverse fold line means to extend respectively from one of the panels of said opposed panels of said other of said first pair of body panels and said second pair of body panels toward the other panel of said opposed panels of said other of said first pair of body panels and said second pair of body panels.

20. A container according to claim 12 and further comprising vent hole means along said third transverse fold line.

21. A container according to claim 20 and further comprising vent hole means along said fourth transverse fold line.

22. A container according to claim 12 wherein said third transverse fold line and said fourth transverse fold line are longer than said first transverse fold line and said second transverse fold line.

23. A container according to claim 22 wherein the distance from the free edge of said one of said second pair of flaps of said second flap means to said first transverse fold line plus the distance from the free edge of said other of said second pair of flaps of said second flap means to said second transverse fold line is less than the length of said first transverse fold line.

24. A container according to claim 15 wherein said second intermediate fold line is spaced inwardly from said inner ends of said parallel cut lines of said other of said second pair of flaps of said second flap means by a distance at least equal approximately to one inch.

25. A generally rectangular unitary blank of a relatively rigid, foldable sheetlike material, said blank comprising:

four serially connected and generally rectangularly shaped body panels, said panels being separated by scored or otherwise deformed fold lines at the junctures between said panels, said panels being adapted to be folded at said fold lines into an open ended tubular configuration of generally rectangular cross-section which has a first pair of opposed, spaced apart sides that extend generally parallel to one another and a second pair of opposed, spaced apart sides that extend generally parallel to one another and generally transversely of said first pair of opposed, spaced apart panels, said panels having a first end extending transversely of said fold lines and a second end extending transversely of said fold lines;

first flap means at one of said first end and said second end, said first flap means comprising a pair of flaps, one of said pair of flaps having a free edge and being attached to one of said first pair of body panels at a first scored or otherwise deformed transverse fold line, said one of said pair of flaps further being foldable at said first transverse fold line to extend transversely with respect to said one of said first pair of body panels toward the other of said first pair of body panels, the other of said pair of flaps having a free edge and being attached to the other of said first pair of body panels at a second scored or otherwise deformed transverse fold line, said other of said pair of flaps further being foldable at said second transverse fold line to extend transversely with respect to said other of said first pair of body panels toward said one of said first pair of body panels, said one of said pair of flaps comprising an elongate slot extending transversely substantially from said first transverse fold line partly to the free edge of said one of said pair of flaps, said other of said pair of flaps comprising an elongate slot extending transversely substantially from said second transverse fold line partly to the free edge of said other of said pair of flaps; and second flap means at said one of said first end and said second end, said second flap means comprising at least one flap, said at least one flap having a free edge and being attached to one of said second opposed pair of body panels at a third scored or otherwise deformed transverse fold line and being foldable at said third transverse fold line to extend transversely with respect to said one of said second opposed pair of body panels toward the other of said second opposed pair of body panels, said at least one flap being cut along spaced apart, parallel cut lines extending transversely from said free edge of said at least one flap partly to said third transverse fold line to form first and second and tabs and an intermediate tab between said first and second end tabs in said free edge of said least one flap, a first inward portion between said first end tab and said third transverse fold line and a second inward portion between said second end tab and said third transverse fold line, said first end tab being receivable in said elongate slot in said one of said pair of flaps interiorly of said one of said pair of flaps, said second end tab being receivable in said elongate slot in the other of said pair of flaps interiorly of said other of said pair of flaps, said intermediate tab, said first inward portion and said second inward portion being positionable exteriorly of said one of said pair of flaps and said other of said pair of flaps, said first end tab being non-hingedly connected to to said second transverse fold line said first inward portion.

26. A blank according to claim 25 wherein said second end tab is non-hingedly connected to an immediately adjacent portion of said second inward portion.

27. A blank according to claim 26 wherein said at least one flap of said second flap means is deformed along an intermediate fold line which is positioned between said free edge of said at least one flap and said third transverse fold line and which extends generally parallel to said third transverse fold line, said intermediate fold line being spaced inwarldy of inner ends of each of spaced apart parallel cut lines, said intermediate fold line permitting bending of said intermediate tab portion with respect to other portions of said at least one flap of said second flap means to permit said first end tab to be inserted into said elongate slot in said one of said pair of flaps and to permit said second end tab to be inserted into said elongate slot in said other of said pair of flaps.

28. A blank according to claim 27 wherein said foldable, sheetlike material is corrugated fiberboard.

29. A blank according to claim 25 wherein said third transverse fold line is longer than said first transverse fold line and said second transverse fold line.

30. A blank according to claim 29 further comprising;

third flap means at the other of said first end and said second end, said third flap means comprising a second pair of flaps, the flaps of said second pair of flaps respectively being attached to opposed panels of one of said first pair and said second pair of body panels at fourth and fifth scored or otherwise deformed transverse fold lines which are respectively spaced from said first and second transverse fold lines, and which extend parallel thereto, said second pair of flaps being foldable respectively at said fourth and fifth transverse fold lines to extend transversely respectively from the one of the panel of said opposed panels of said one of said first pair of body panels and said second pair of body panels toward the other panel of said opposed panels of said one of said first pair of body panels and said second pair of body panels and fourth flap means at said other of said first end and said second end, said fourth flap means comprising a third pair of flaps, the flaps of said third pair of flaps of said fourth flap means respectively being attached to opposed panels of the other of said first pair and said second pair of body panels at sixth and seventh transverse fold lines one of which is spaced from said second transverse fold line and extends parallel thereto, and being foldable respectively at said sixth and seventh transverse fold lines to extend respectively from one of the panels of said opposed panels of said other of said first pair of body panels and said second pair of body panels toward the other panel of said opposed panels of said other of said first pair of body panels and said second pair of body panels.

31. A blank according to claim 30 and further comprising vent hole means along said third transverse fold line.

32. A blank according to claim 31 and further comprising second vent hole means along one of said fourth, fifth. sixth and seventh transverse fold lines.

33. A blank according to claim 25 wherein said intermediate fold line is spaced inwardly from said inner ends by a distance at least equal to approximately one inch.

34. A shipping container having an interior and an exterior and being formed from a generally rectangular blank of a relatively rigid, foldable corrugated fibreboard, said container comprising:

a tubular body portion formed from four serially connected body panels in said blank by bending along fold lines at the junctures of said body panels and by connecting the first and last of said serially connected body panels to one another, said tubular body portion including a first pair of opposed, spaced apart body panels that extend generally parallel to one another and a second pair of opposed, spaced apart body panels that extend generally parallel to one another and generally transversely of said first pair of opposed, spaced apart body panels, said tubular body portion having a first end extending transversely of said body panels and a second end spaced from said first end and extending transversely of said body panels; and self-locking means closing one of said first end and said second end of said tubular body portion, said self-locking means comprising:

first flap means comprising a pair of flaps, one of said pair of flaps having a free edge and being foldably attached to one of said first pair of body panels at a first transverse fold line, said one of said pair of flaps further being folded at said transverse fold line to extend transversely with respect to said one of said first pair of body panels toward the other of said first pair of body panels, the other of said pair of flaps having a free edge and being foldably attached to the other of said first pair of body panels at a second transverse fold line, said other of said pair of flaps further being folded at said second transverse fold line to extend transversely with respect to said other of said first pair of body panels toward said one of said first pair of body panels, said one of said pair of flaps comprising at least one elongate slot extending transversely substantially from said first transverse fold line partly to the free edge of said one of said pair of flaps, said other of said pair of flaps comprising at least one elongate slot extending transversely substantially from said second transverse fold line partly to the free edge of said other of said pair of flaps; and second flap means comprising at least one flap, said at least one flap having a free edge and being foldably attached to one of said second opposed pair of body panels at a third transverse fold line and being folded at said third transverse fold line to extend transversely with respect to said one of said second opposed pair of body panels toward the other of said second opposed pair of body panels, said at least one flap being cut along spaced apart, parallel cut lines extending transversely from said free edge of said at least one flap partly to said third transverse fold line to form first and second end tabs and an intermediate tab between said first and second end tabs in said free edge of said at least one flap, a first inward portion between said first end tab and said third transverse fold line and a second inward portion between said second end tab and said third transverse fold line, said first end tab being received in said at least one elongated slot in said one of said pair of flaps interiorly of said one of said pair of flaps, said second end tab being received in said at least one elongate slot in the other of said pair of flaps interiorly of said other of said pair of flaps, said intermediate tab, said first inward portion and said second inward portion being positioned exteriorly of said one of said pair of flaps and said other of said pair of flaps, said first end tab being substantially coplanar with an immediately adjacent portion of said first inward portion and being non-hingedly connected thereto, said second end tab being substantially coplanar with an immediately adjacent portion of said second inward portion and being non-hingedly connected thereto;

wherein said at least one flap of said second flap means is deformed along an intermediate fold line which is positioned between said free edge of said at least one flap and said third transverse fold line and which extends generally parallel to said third transverse fold line, said intermediate fold line comprising a spaced apart series of perforations in said blank therealong and being spaced inwardly of inner ends of each of said spaced apart, cut lines, said fold line permitting bending of said intermediate tab portion with respect to other portions of said at least one flap of said second flap means to permit said first end tab to be inserted into said at least one elongate slot in said one of said pair of flaps and to permit said second end tab to be inserted into said at least one elongate slot in said other of said pair of flaps.

35. A shipping container having an interior and an exterior and being formed from a generally rectangular blank of a relatively rigid, foldable corrugated fibreboard, said container comprising:

a tubular body portion formed from four serially connected body panels in said blank by bending along fold lines at the junctures of said body panels and by connecting the first and last of said serially connected body panels to one another, said tubular body portion including a first pair of opposed, spaced apart body panels that extend generally parallel to one another and a second pair of opposed, spaced apart body panels that extend generally parallel to one another and generally transversely of said first pair of opposed, spaced apart body panels, said tubular body portion having a first end extending transversely of said body panels and a second end spaced from said first end and extending transversely of said body panels; and self-locking means closing one of said first end and said second end of said tubular body portion, said self-locking means comprising:

first flap means comprising a pair of flaps, one of said pair of flaps having a free edge and being foldably attached to one of said first pair of body panels at a first transverse fold line, said one of said pair of flaps further being folded at said transverse fold line to extend transversely with respect to said one of said first pair of body panels toward the other of said first pair of body panels, the other of said pair of flaps having a free edge and being foldably attached to the other of said first pair of body panels at a second transverse fold line, said other of said pair of flaps further being folded at said second transverse fold line to extend transversely with respect to said other of said first pair of body panels toward said one of said first pair of body panels, said one of said pair of flaps comprising a pair of spaced apart elongate slots extending transversely substantially from said first transverse fold line partly to the free edge of said one of said pair of flaps, said other of said pair of flaps comprising a second pair of elongate slots extending transversely substantially from said second transverse fold line partly to the free edge of said other of said pair of flaps; and second flap means comprising a second pair of flaps, one of said second pair of flaps of said second flap means having a free edge and being foldably attached to one of said second opposed pair of body panels at a third transverse fold line and being folded at said third transverse fold line to extend transversely with respect to said one of second opposed pair of body panels toward the other of said second opposed pair of body panels, said one of said second pair of flaps of said second flap means being cut along spaced apart, parallel cut lines extending transversely from said free edge of said second pair of flaps of said second flap means partly to said third transverse fold line to form first and second end tabs and an intermediate tab between said first and second end tabs in said free edge of said one of said second pair of flaps of said second flap means, a first inward portion between said first end tab and said third transverse fold line and a second inward portion between said second end tab and said third transverse fold line, said first end tab being received in one of said pair of spaced apart elongate slots in said one of said pair of flaps of said first flap means interiorly of said one of said pair of flaps of said first flap means, said second end tab being received in one of said elongate slots in the other of said pair of flaps interiorly of said other of said pair of flaps, said intermediate tab, said first inward portion and said second inward portion being positioned exteriorly of said one of said pair of flaps and said other of said pair of flaps, said first end tab being substantially coplanar with said inward portion and being non-hingedly connected thereto, the other of said second pair of flaps having a free edge and being foldably attached to the other of said second opposed pair of body panels at a fourth transverse fold line and being folded at said fourth transverse fold line to extend transversely with respect to said other of said second opposed pair of body panels toward said one of said second pair of body panels, said other of said second pair of flaps being cut along spaced apart, parallel cut lines extending transversely from said free edge of said other of said second pair of flaps partly to said fourth transverse fold line to form third and fourth end tabs in said free edge of said other of said second pair of flaps, a third inward portion between said third end tab and said fourth transverse fold line and a fourth inward portion between said fourth end tab and said fourth transverse fold line, said third end tab being received in the other of said pair of spaced apart elongate slots in said one of said pair of flaps of said first flap means interiorly of said one of said pair of flaps of said first flap means, said fourth end tab being received in the other of said elongate slots in the other of said pair of flaps interiorly of said one of said pair of flaps of said first flap means, said second intermediate tab, said third inward portion and said fourth inward portion being positioned exteriorly of said one of said pair of flaps and said other of said other of said pair of flaps, said third end tab being substantially coplanar with said third inward portion and being non-hingedly connected thereto, and said fourth end tab being substantially coplanar with said fourth end tab and being non-hingedly connected thereto;

wherein said one of said second pair of flaps of said second flap means is deformed along an intermediate fold line which is positioned between said free edge of said one of said second pair of flaps and said third transverse fold line and which extends generally parallel to said third transverse fold line, and intermediate fold line comprising a spaced apart series of perforations in said blank therealong and being spaced inwardly of inner ends of each of said spaced apart, parallel cut lines of said one of said second pair of flaps of said second flap means, said intermediate fold line permitting bending of said intermediate tab portion with respect to other portions of said one of said second pair of flaps of said second flap means to permit said first end tab to be inserted into said one of said elongate slots in said one of said first pair of flaps of said first flap means and to permit said second end tab to be inserted into said one of said elongate slots in said other of said pair of flaps of said first flap means; and wherein said other of said second pair of flaps of said second flap means is deformed along a second intermediate fold line which is positioned between said free edge of said other of said second pair of flaps of said second flap means and said fourth transverse fold line and which extends generally parallel to said fourth transverse fold line, said second intermediate fold line being spaced inwardly of inner ends of each of said spaced apart, parallel cut lines of said other of said second pair of flaps of said second flap means, said second intermediate fold line permitting bending of said second intermediate tab with respect to the other portions of said other of said second pair of flaps of said second flap means to permit said third end tab to be inserted into the other of said elongate slots in said one of said first pair of flaps of said first flap means and to permit said fourth end tab to be inserted into the other of said elongate slots in said other of said pair of flaps of said first flap means.

36. A container according to claim 35 wherein said second partial fold line comprises a second series of spaced apart perforations in said blank along said second partial fold line.

37. A generally rectangular unitary blank of a relative rigid, foldable corrugated fibreboard, said blank comprising:

four serially connected and generally rectangularly shaped body panels, said panels being separated by scored or otherwise deformed fold lines at the junctures between said panels, said panels being adapted to be folded at said fold lines into an open ended tubular configuration of generally rectangular cross-section which has a first pair of opposed, spaced apart sides that extend generally parallel to one another and a second pair of opposed, spaced apart sides that extend generally parallel to one another and generally transversely of said first pair of opposed, spaced apart panels, said panels having a first end extending transversely of said fold lines and a second end extending transversely of said fold lines;

first flap means at one of said first end and said second end, said first flap means comprising a pair of flaps, one of said pair of flaps having a free edge and being attached to one of said first pair of body panels at a first scored or otherwise deformed transverse fold line, said one of said pair of flaps further being foldable at said first transverse fold line to extend transversely with respect to said one of said first pair of body panels, the other of said pair of flaps having a free edge and being attached to the other of said first pair of body panels at a second scored or otherwise deformed transverse fold line, said other of said pair of flaps further being foldable at said second transverse fold line to extend transversely with respect to said other of said first pair of body panels toward said one of said first pair of body panels, said one of said pair of flaps comprising an elongate slot extending transversely substantially from said first transverse fold line partly to the free edge of said one of said pair of flaps, said other of said pair of flaps comprising an elongated slot extending transversely substantially from said second transverse fold line partly to the free edge of said other of said pair of flaps; and second flap means at said one of said first end and said second end, said second flap means comprising at least one flap, said at least one flap having a free edge and being attached to one of said second opposed pair of body panels at a third scored or otherwise deformed transverse fold line and being foldable at said third transverse fold line to extend transversely with respect to said one of said second opposed pair of body panels toward the other of said second opposed pair of body panels, said at least one flab being cut along spaced apart, parallel cut lines extending transversely from said free edge of said at least one flap partly to said third transverse fold line to form first and second end tabs and an intermediate tab between said first and second end tabs, a first inward portion between said first end tab and said third transverse fold line and a second inward portion between said second end tab and said third transverse fold line, said first end tab being receivable in said elongate slot in said one of said pair of flaps interiorly of said one of said pair of flaps, said second end tab being receivable in said elongated slot in the other of said pair of flaps interiorly of said other of said pair of flaps, said intermediate tab, said first inward portion and said second inward portion being positionable exteriorly of said one of said pair of flaps and said other of said pair of flaps, said first end tab being non-hingedly connected to said first inward portion, said second end tab being non-hingedly connected to said second inward portion;

wherein said at least one flap of said second flap means is deformed along an intermediate fold line which is positioned between said free edge of said at least one flap and said third transverse fold line and which extends generally parallel to said third transverse fold line, said intermediate fold line comprising a spaced apart series of perforations in said blank therealong and being spaced inwardly of inner ends of each of spaced apart, parallel cut lines, said intermediate fold line permitting bending of said intermediate tab portion with respect to other portions of said at least one flap of said second flap means to permit said first end tab to be inserted into said elongate slot in said one of said pair of flaps and to permit said second end tab to be inserted into said elongate slot in said other of said pair of flaps.

* * * * *

UNITED STATES PATENT AND TRADEMARK OFFICE

CERTIFICATE OF CORRECTION

PATENT NO. : 4,953,782

DATED : September 4, 1990

INVENTOR(S) : Carl M. Noland

It is certified that error appears in the above-identified patent and that said Letters Patent is hereby corrected as shown below:

On the title page, in item [57]:
In the Abstract, line 2, "a tubular body" should be deleted.

| | | | |
|---|---|---|---|
| Claim 25, | column 14, | line 53, | "and" should be --end--, |
| | column 15, | line 1, | delete "to said second transverse fold line" and insert --an immediately adjacent portion of--. |
| Claim 35, | column 17, | line 58, | after "said" (second occurrence) insert --first--, |
| | column 18, | line 17, | after "of" insert --said--, |
| | column 18, | line 23, | after "said" (second occurrence) insert --one of said--, |
| | column 19, | line 18, | delete "and" insert --said--. |
| Claim 37, | column 19, | line 57, | add --ly-- to "relative", |
| | column 20, | line 41, | "flab" should be --flap--. |

Signed and Sealed this

Seventh Day of January, 1992

*Attest:*

*Attesting Officer*

HARRY F. MANBECK, JR.

*Commissioner of Patents and Trademarks*